United States Patent [19]

Bixby

[11] 4,210,710

[45] Jul. 1, 1980

[54] PHOTOCONDUCTOR OF VARYING LIGHT SENSITIVITY FROM CENTER TO EDGES

[75] Inventor: William E. Bixby, Deerfield, Ill.

[73] Assignee: A. B. Dick Company, Niles, Ill.

[21] Appl. No.: 919,089

[22] Filed: Jun. 26, 1978

[51] Int. Cl.[2] ..... G03G 5/04; G03G 5/082

[52] U.S. Cl. ..... 430/56; 430/128; 430/133; 430/81; 427/76

[58] Field of Search ..... 96/1.5 R, 1.6, 1.7, 96/1.8; 427/76

[56] References Cited

U.S. PATENT DOCUMENTS

| | | | |
|---|---|---|---|
| 2,599,542 | 6/1952 | Carlson | 96/1.5 R |
| 2,917,385 | 12/1959 | Byrne | 96/1.5 R |
| 3,681,071 | 8/1972 | Donald | 96/1.8 |
| 3,754,908 | 8/1973 | Hercock et al. | 96/1.7 X |
| 3,979,495 | 9/1976 | Erhardt | 96/1.5 R X |
| 4,126,457 | 11/1978 | Ciuffini | 96/1.5 R |

FOREIGN PATENT DOCUMENTS

| | | | |
|---|---|---|---|
| 1381342 | 11/1964 | France | 96/1.6 |

*Primary Examiner*—Roland E. Martin, Jr.
*Attorney, Agent, or Firm*—McDougall, Hersh & Scott

[57] ABSTRACT

A member for electrostatographic reproduction formed of a substrate and having a photoconductive layer characterized by a sensitivity to light which is greater at the outer portions than at the center to compensate for fall-off at the extremes of radiation patterns.

7 Claims, No Drawings

PHOTOCONDUCTOR OF VARYING LIGHT SENSITIVITY FROM CENTER TO EDGES

BACKGROUND OF THE INVENTION

This invention relates to electrostatographic production of copies and method and apparatus for the production of same.

In this specification, the expression "electrostatographic reproduction machine" refers to a machine for producing one or more prints or copies from at least one electrostatic latent image. The expression "electrostatographic member" refers to a member for producing and utilizing an electrostatic latent image.

The production of an electrostatic latent image may be carried out in various ways as is well known. The basic and most conventional electrostatographic process or method is described in U.S. Pat. No. 2,297,691. This method involves producing a uniform electrostatic charge on a photoconductive insulating layer. In practice, it is possible for the insulating layer to have a protective overlayer or other overlayer known in the art of xerography. The charged layer is exposed to imaging radiation (especially light) to discharge selectively the photoconductive layer to form the electrostatic latent image. The latent image may then be developed in any known way. Examples of known development methods, for example, are "cascade development" described in U.S. Pat. No. 2,221,776; and "magnetic brush development" described in U.S. Pat. No. 2,874,063. Another example of a known development method is a liquid development method described in U.S. Pat. No. 3,084,043. In this method, development is carried out with a polar liquid developer. Such a developer is stable, i.e. it will respond to an electrostatic field as a homogeneous unit without separation of the components of the liquid developer. As described in U.S. Pat. No. 3,084,043, the polar liquid developer is applied by a rotatable member having a plurality of raised portions defining a substantially regular patterned surface and a plurality of portions depressed or sunken below the raised portions. The liquid developer is present in the depressed portions and is doctored by a doctor blade.

In present electrostatographic machines the photoconductive layer is charged as far as practically possible uniformly along its length. In such machines imaging radiation is normally directed through an optical system from an original document to be copied. Conventional or even especially designed optical systems exhibit an inherent fall-off of efficiency in the optical components at their extreme fields of view. In well known automatic electrostatographic machines, it is usual to move the original to be copied, the photoconductive layer or both in synchronism during the step of imaging to provide a scanning operation. The radiation is directed through a slit or aperture which regulates the time of exposure. Present day machines often compensate for fall-off of efficiency by providing a "bow-tie" or "butterfly" type aperture in the optical system in a plane at right angles to the line of scanning.

The bow-tie aperture is narrower at its center than at its extremities and is conventionally placed near the drum surface. The size of the opening controls the duration of light exposure of the portion of the photoconductor surface passing beneath it. Thus, at its extremities it is made as wide as possible to permit the longest exposure possible to compensate for the relatively low light intensity in that area. However, the width is limited by resolution loss that accompanies a wide aperture. The product of the exposure time (aperture width) and illumination intensity defines the exposure.

To make the exposure equivalent at the center of the photoconductor where the intensity is greater, the aperture must be made narrower and thus causing reduction of the exposure time. The result is failure to utilize a good portion of the light provided by the optical system because the aperture edges intercept and absorb a portion of the light defined image pattern which would otherwise strike the photoconductive surface and form the latent image charge pattern.

Techniques other than optical have been proposed for compensation for fall-off at the extremes of the radiation pattern. British Pat. No. 1,502,146 suggests the use of a differentially charged photoconductive layer as a means for compensating for fall-off, the differential charge being created by a uniform charging step followed by a non-uniform discharge step in which the photoconductor is exposed to a non-uniform radiation source. In U.S. Pat. No. 4,072,413, description is made of the use of a corotron arranged differentially to charge the photoconductive layer such that the layer is selectively more highly charged in the central portion to compensate for differential reduction of the imaging radiation in the formation of the latent image.

Another instance where non-uniform exposure occurs is in more recently introduced laser exposed imaging systems. Unless sophisticated electronic corrections are used, the linear sweep of the laser beam is faster at the ends of each scan than at the center. In addition, the scanning system itself is less transmissive at the extremes of its sweep than at the center. Together, these losses may be as great at 50% of the center intensity. By employing a photoconductor tailored to compensate for the uneven exposure, a uniform result can be obtained.

SUMMARY OF THE INVENTION

In accordance with the practice of this invention, the uneveness of light intensity from the edges to the center during radiation of the photoconductive layer is accepted as normal and compensation therefor is effected by tailoring the photoreceptor to vary its sensitivity, thereby to provide a photoreceptor layer which increases in sensitivity from the center to the edges or ends of the exposure slit.

The desired results can be achieved when the photoconductive coating gradually increases in light sensitivity from the center outwardly towards the edges or when the photoconductive layer is formed of two or more laterally disposed segments, with the outermost segments having greater light sensitivity than the segments at the center.

The described construction of the photoconductive layer can be achieved in a number of ways, depending primarily on the materials of which the photoconductive layer is formed.

In the case of selenium, the photoconductive layer is currently formed on the surface of the substrate cylinder while the cylinder is being rotated about a horizontal axis a few inches above a source boat aligned with the cylinder axis and dimensioned to extend well beyond the ends of the cylinder. The source boat and cylinder are confined within an evacuated space for vaporization of the selenium heated to the molten state within the source boat whereby condensation of selenium vapors on the surface of the rotating cylinder results in the disposition of a uniform layer of photoconductive selenium on the surface of the cylinder substrate.

The desired variation in light sensitivity of the selenium layer formed on the cylindrical substrate by vapor deposition, can be achieved by slight modification of the described conventional processes for forming the photoconductive layer, as by subdividing the source boat into separate compartments in the axial direction and distributing the amount and/or composition of the selenium or other photoconductive material in each compartment to provide a selenium composition or other photoconductive material of greater light sensitivity in the outer compartments as compared to the light sensitivity of the selenium composition or other photoconductive material in the center. The result from conventional vapor deposition procedures is a photoconductive layer on the surface of the cylinder or drum which is continuous and of uniform thickness with gradual increase in light sensitivity from the central portion of the cylinder to the outer edge. Segmentation for stepwise increase in light sensitivity can be achieved by carrying the compartmentalization to the cylinder as by means of dividers which extend from the compartment walls of the source boat to just short of the peripheral surface of the cylinder so that the area between the dividers will be coated primarily from the vapors rising from the radially aligned compartments with a blend from adjacent compartments at the common line in between.

In practice, the desired results are secured by variation of the amount of photoconductive material deposited on the surface of the substrate and/or by varying the composition of the photoconductive material in each compartment. Thus, at the center compartments, corresponding to the resultant central portion of the photoconductive layer formed on the finished drum, a normal type of photoconductive vaporizable selenium is placed. In the compartments outwardly thereof, use is made of a photoconductive material having a higher speed or light sensitivity. The result is a drum that is more sensitive near its end portions than at the center. This then compensates for the weaker illumination at the end portions relative to the central portion during exposure to form the latent electrostatic image. In a preferred alternative, the amount and type of photoconductive selenium deposited on the surface of the drum can be achieved by sequential depositions wherein deposition is first made from boats containing selenium of one composition while one or more subsequent depositions can be made with the boats containing selenium of the same or different compositions but in which the amount of selenium varies from the outer boats to the central boats to provide for a photoconductive layer in which the selenium in the outer portions is characterized by greater speed or light sensitivity than at the center.

When the photoconductive layer on a copy sheet or a drum of cylindrical shape is formed of an organic photoconductive composition, such as described in U.S. Pat. No. 3,929,478 entitled "Electrophotographic Element which Includes a Photoconductive Polyvinyl Carbazole Layer Containing an Alicyclic Anhydride", U.S. Pat. No. 3,928,035 entitled "Electrophotographic Element which Includes a Photoconductive Polyvinyl Carbazole Layer Containing an Aromatic Anhydride" and Application Ser. No. 739,651, filed Nov. 8, 1976, entitled "Vinyl Polymerization with Boron Chelates as Catalyst and Photoconductive Sensitizer", compositions which provide coatings of increasing speeds or light sensitivity may be separately applied to adjacent segments of the conductive substrate, with the coating of organic photoconductive material of higher speeds being applied to the lateral end portions of the substrate by comparison with the compositions used to form the central portion of the photoconductive coating. By subdividing the substrate into a number of segments, the sensitivity can be made gradually to increase from the center outwardly, or segments of different sensitivities to light can be formed with the segment of greatest speed in the outermost portion by comparison with the central portion.

Having described the basic concepts, the invention will now be illustrated by the following examples which will be given by way of illustration but not by way of limitation.

EXAMPLE 1

A suitably cleaned cylindrical aluminum substrate is mounted on a horizontal mandrel and rotated at a rate of about 12 rpm. Beneath the cylindrical member, at a distance of 4.5", are placed two stainless steel evaporation boats which are dimensioned to extend beyond the lateral edges of the cylindrical member and separated from each other by a minimal distance. Each boat is subdivided into multiple compartments of 3" in length and the material to be deposited onto the surface of the cylindrical member is deposited non-uniformly into the six central compartments of each boat in a manner to give a uniform coating thickness on the finished cylindrical member.

In boat No. 1, a stabilized selenium is loaded as follows in the central compartments:

| Compartment Number | 1 | 2 | 3 | 4 | 5 | 6 |
|---|---|---|---|---|---|---|
| Weight of Selenium in grams | 20 | 24 | 23 | 23 | 24 | 20 |

In boat No. 2, various tellurium alloys of selenium are loaded in the following manner in the central compartments:

| Compartment Number | 1 | 2 | 3 | 4 | 5 | 6 |
|---|---|---|---|---|---|---|
| Weight of alloy in grams | 1.5 | 2.0 | 2.0 | 2.0 | 2.0 | 1.5 |
| % Tellurium in alloy (remainder selenium) | 9 | 4 | 0 | 0 | 4 | 9 |

The so loaded chamber is then enclosed and evacuated to a pressure of $5\times10^{-5}$ torr. The temperature of the substrate is brought to 65° C. and current is passed through boat No. 1 to raise its temperature to 270° C. for 8 minutes. Current is turned off from the first boat and applied to boat No. 2 to raise the temperature thereof to 300° C. at which temperature it is held for 3½ minutes.

The vacuum chamber is then inerted by backfilling with gaseous nitrogen and the cylindrical member is removed.

When the electro-optical characteristics of the cylindrical member are measured using a tungsten source, the areas near the ends of the cylindrical member are found to have almost double the sensitivity by comparison with the area at the center of the cylindrical member. Thus the photoconductive member is tailored to work in a machine having a uniform wide open exposure aperture which may have as much as 50% illumination fall-off at the edges.

EXAMPLE 2

An aluminized mylar substrate is supported on a rotatable drum, the circumference of which measures the length of the desired photoconductor and the length of which measures the width of the desired photoconductor. Spaced circumferentially of the peripheral surface of the drum are a series of axially spaced air brushes the patterns of which somewhat overlap each other.

The air brushes addressed to the central portion of the drum were supplied with the following coating composition:

Composition A 24.8 gr. 2,4,7-trinitro-9-fluorenone (TNF) from Aldrich Chemical Company; 575 ml. tetrahydrofuran previously dried over nitrogen; 160 ml of a 10% solution in tetrahydrofuran of poly-N-vinylcarbazole from Ionac Chemical Company.

Composition B

Composition B is the same as composition A except that the amount of TNF was reduced to 0.4 of the amount in composition A.

The two compositions were milled on a rotor mill immediately prior to coating. The drum was rotated at 13 rpm and while composition A was sprayed onto the surface of the drum from the air brushes aligned with the outer portions of the drum, the air brushes facing the central portion of the drum were supplied with composition B. Application was made until the aluminized surface was uniformly covered with a coating having a thickness within the range of 5–20 microns and then the coated substrate was allowed to air dry after which it was cured for 60 minutes at 50° C.

The result of the reduction in the amount of TNF in composition B is about a 50% reduction in the sensitivity of the applied coating. Reference can be made to page 383 of the publication entitled "Electrophotography", by R. M. Schaffert for means for tailoring the polyvinyl carbazole-TNF system for adjusting the composition to various degrees of sensitivity. The result of the above is a photoconductive coating characterized by light sensitivity which is greater at the outer portions than at the center.

While the inventive concept has been specifically illustrated by selenium and polyvinyl carbazole-TNF as representative of inorganic and organic compositions which may be used in the preparation of photoconductive coatings with variation in light sensitivity from the center outwardly, it will be understood that the concepts of this invention can be practiced with other inorganic or organic photoconductive coating compositions of the type well known to the skilled in the art.

It will be understood that changes will be made in the details of construction, arrangement and operation without departing from the spirit of the invention, especially as defined in the following claims.

I claim:

1. A photoconductor comprising a substrate and a photoconductive layer on the substrate characterized by a sensitivity to light which is greater in the outer edge portions of the photoconductive layer than at the central portion of the photoconductive layer in which said photoconductive layer increases in light sensitivity from said central portion to said outer edge portions.

2. A photoconductor as claimed in claim 1 in which the photoconductive layer is based on photoconductive selenium with the selenium making up the central portion of the layer being characterized by a photoconductivity which is less than the photoconductivity of the selenium or its alloy making up the outer portions of the layer.

3. A photoconductor comprising a substrate and a photoconductive layer on the substrate characterized by a sensitivity to light which is greater in the lateral edge portions than at the central portion in which the substrate is in the form of a drum, and the photoconductive layer is on the surface of the drum, said layer being of uniform thickness and of increasing light sensitivity from the center to the outer portions thereof.

4. A photoconductor as claimed in claim 1 in which the photoconductive layer comprises an organic coating of photoconductive material which varies in composition to provide a layer having a higher photoconductivity at the outer portions of the layer than at the central portion of the layer.

5. A photoconductor comprising a substrate and a photoconductive layer on the substrate characterized by a sensitivity to light which is greater in the lateral edge portions than at the central portion, in which the photoconductive layer comprises an organic coating of photoconductive material which varies in composition to provide a layer having a higher conductivity at the outer portions of the layer than at the central portion of the layer and in which the organic photoconductive coating is formulated of poly-N-vinyl-carbazole-trinitro-9-fluorenone in which the proportion of the latter varies to provide the desired variation in photosnesitivity of the coating from the central portion outwardly.

6. A photoconductor comprising a substrate and a photoconductive layer on the substrate characterized by a sensitivity to light which is greater in the lateral edge portions than at the central portion, in which the photoconductive layer comprises an organic coating of photoconductive material which varies in composition to provide a layer having a higher conductivity at the outer portions of the layer than at the central portion of the layer and in which the organic photoconductive coating increases in photoconductivity from the center to the outer portions thereof.

7. The method of producing a photoconductor as claimed in claim 1 comprising applying separate photoconductive coating compositions to a substrate with the coating composition applied to the central portion of the substrate providing a layer having a lower sensitivity to light than the layer formed by the coating composition applied to the outer portions of the substrate in which said photoconductor increases in light sensitivity from said central portion to said outer portions.

* * * * *